US007284681B2

(12) United States Patent
Hagihara

(10) Patent No.: US 7,284,681 B2
(45) Date of Patent: Oct. 23, 2007

(54) STRUCTURE FOR JOINING A SHEET MEMBER AND A TUBULAR MEMBER IN A POUCH CONTAINER

(76) Inventor: Tadashi Hagihara, 1791-4 Yamazaki, Mobara-shi, Chiba 297-0061 (JP)

( * ) Notice: Subject to any disclaimer, the term of this patent is extended or adjusted under 35 U.S.C. 154(b) by 513 days.

(21) Appl. No.: 11/023,339

(22) Filed: Dec. 29, 2004

(65) Prior Publication Data

US 2005/0173455 A1 Aug. 11, 2005

Related U.S. Application Data

(63) Continuation-in-part of application No. 10/298,015, filed on Nov. 18, 2002, now Pat. No. 6,851,578, which is a continuation of application No. 09/869,043, filed as application No. PCT/JP98/05803 on Dec. 22, 1998, now Pat. No. 6,578,740.

(51) Int. Cl.

| | |
|---|---|
| ***B65D 35/008*** | (2006.01) |
| ***B65D 25/04*** | (2006.01) |
| ***B65D 33/016*** | (2006.01) |
| ***B65D 30/016*** | (2006.01) |
| ***F16L 27/00*** | (2006.01) |

(52) U.S. Cl. ..... 222/107; 222/215; 222/490; 285/136.1; 383/80; 383/104

(58) Field of Classification Search ..... 222/107, 222/212, 215, 490, 491; 285/136.1; 383/104, 383/80

See application file for complete search history.

(56) References Cited

U.S. PATENT DOCUMENTS

| | | | | |
|---|---|---|---|---|
| 2,682,974 | A * | 7/1954 | Smith | 222/107 |
| 2,936,940 | A | 5/1960 | Berghgracht | |
| 3,136,475 | A | 6/1964 | Geimer | |
| 5,005,734 | A | 4/1991 | Van Gordon et al. | |
| 5,226,564 | A * | 7/1993 | Steer et al. | 222/107 |
| 5,350,240 | A | 9/1994 | Billman et al. | |
| 5,411,203 | A | 5/1995 | Bochet et al. | |
| 5,564,591 | A | 10/1996 | Christine et al. | |

(Continued)

FOREIGN PATENT DOCUMENTS

| | | |
|---|---|---|
| JP | 55-125091 | 9/1982 |

(Continued)

*Primary Examiner*—Kevin Shaver
*Assistant Examiner*—Melvin A. Cartagena
(74) *Attorney, Agent, or Firm*—Wenderoth, Lind & Ponack, L.L.P.

(57) ABSTRACT

A self-standing type bag-shaped vacuum container has a self-standing container including a wall formed of a soft sheet, a pouring port, and a check valve mounted in the pouring port. The check valve is opened to allow the migration of a content of the container when subjected to a pressure in the pouring direction, but is closed when subjected to a pressure in a filling direction, so that the inside of the container is evacuated. The self-standing container can be optimized for storing beverages or the like which are negatively effected by contact with air, because the content will be oxidized with the air. The vacuum type container will not lose its self-standing property even if the content is reduced, and can stand stably by itself.

1 Claim, 8 Drawing Sheets

U.S. PATENT DOCUMENTS

| | | | | |
|---|---|---|---|---|
| 6,050,451 | A | 4/2000 | Hess, III et al. | |
| 6,164,822 | A | 12/2000 | Beer | |
| 6,209,754 | B1 | 4/2001 | Suzumi | |
| 6,273,307 | B1 | 8/2001 | Gross et al. | |
| 6,277,422 | B1 * | 8/2001 | Gale | 426/115 |

FOREIGN PATENT DOCUMENTS

| | | |
|---|---|---|
| JP | 58-179841 | 6/1985 |
| JP | 63-162993 | 6/1990 |
| JP | 10-129683 | 5/1998 |
| JP | 10-152147 | 6/1998 |

* cited by examiner (a)

(b)

(c)

(a)

(b)

(c)

STRUCTURE FOR JOINING A SHEET MEMBER AND A TUBULAR MEMBER IN A POUCH CONTAINER

This application is a continuation-in-part application of Ser. No. 10/298,015, filed Nov. 18, 2002 now U.S. Pat No. 6,851,578, which is a continuation of Ser. No. 09/869,043, filed Jun. 22, 2001 now U.S. Pat. No. 6,578,740, which is a National Stage Application of International Application No. PCT/JP98/05803, filed Dec. 22, 1998, which are incorporated herein by reference.

BACKGROUND OF THE INVENTION

1. Field of the Invention

The present invention is related to a so-called standing pouch type self-standing container having wall surfaces formed by a soft sheet in which the bottom portion expands when the container is filled with contents to enable the container to stand on its own, and in particular to a structure for connecting a sheet member and a tubular member in a pouch container.

2. Description of the Prior Art

In the prior art, glass bottles and PET bottles made of plastic have been used as containers for holding beverages and the like.

In a hard container which is typically a PET bottle, the volume of the container itself is not reduced when the contents are reduced. Accordingly, because this hard container has a high stationary property and can form a pressure tight container depending on the shape thereof, it is possible to use such hard container as a pressure tight container for carbonated beverages and the like.

However, in the same manner as glass bottles and the like, hard containers such as PET bottles and the like normally occupy a fixed volume, and the container itself normally takes up a fixed space regardless of the presence or absence of contents. The fact that such hard containers waste space can be understood by imagining the case where a beverage is filled into a container and stored in a refrigerator, for example. Namely, in the case where a 1-liter bottle filled with 200 cc of water is placed in a refrigerator, the bottle wastes a 800 cc volume of space inside the refrigerator.

On the other hand, as people have become more aware of the need to protect the environment in recent years, inexpensive pouch containers have been used by making PET bottles refillable for household cleansers and the like in order to be free from disposable containers. The pouch containers used in such applications are usually self-standing containers referred to as standing pouches because such containers are easy to display in stores.

Recently, pouch containers provided with a tubular pouring port have been used as beverage containers. These pouch containers are soft and collapsible, and because the total volume of the container is reduced when the contents are reduced, the pouch container can be collapsed at the time of disposal, and this serves to reduce the volume of garbage.

However, in the prior art means for joining a soft pouch portion and a hard tubular portion in this type of container, the joint portion can be damaged easily by the stress concentrated on such joint portion regardless of the fact that a sufficient joint strength is not obtained. For this reason, there are no large-volume pouch containers having such prior art structure.

SUMMARY OF THE INVENTION

In order to solve the problems of the prior art described above, it is an object of the present invention to provide a pouch container which can be used in place of prior art hard containers such as bottles and PET bottles and the like, and which is equipped with a structure for joining a sheet member and a tubular member in the pouch container which makes it possible to disperse stress and reliably prevent damage.

Namely, the structure for joining a sheet member and a tubular member in a pouch container of the present invention includes a two-layer resin tube having a nonfusible material arranged on the inside and a fusible material arranged on the outside, a heat-shrinkable tube, a joint tube formed by fusing the resin tube to the inside of a lower end of the heat-shrinkable tube so that the resin tube protrudes a prescribed amount from the lower end of the heat-shrinkable tube, a pouch container body having an upper end opening, a pouring port provided with a joint portion for joining the pouring port to the container body, and at least one groove formed in the joint portion in the circumferential direction, wherein a lower portion of said joint tube is inserted in the upper end opening of the container body, and the container body and the heat-shrinkable tube of the joint tube are fused and then the container body and the resin tube of the joint tube are fused separately, and wherein the joint portion of the pouring port is inserted in the joint tube, and the joint tube is heated to shrink the heat-shrinkable tube in order to fasten the joint portion of the pouring port to the joint tube.

Because the structure for joining a sheet member and a tubular member in the pouch container of the present invention is constructed as described above, the stress on the joint portion is dispersed, and this makes it possible to provide a pouch container which can reliably prevent damage to the joint portion.

DETAILED DESCRIPTION OF THE PREFERRED EMBODIMENTS

The preferred embodiments of the present invention will now be described in detail with reference to the drawings.

Figure 1:
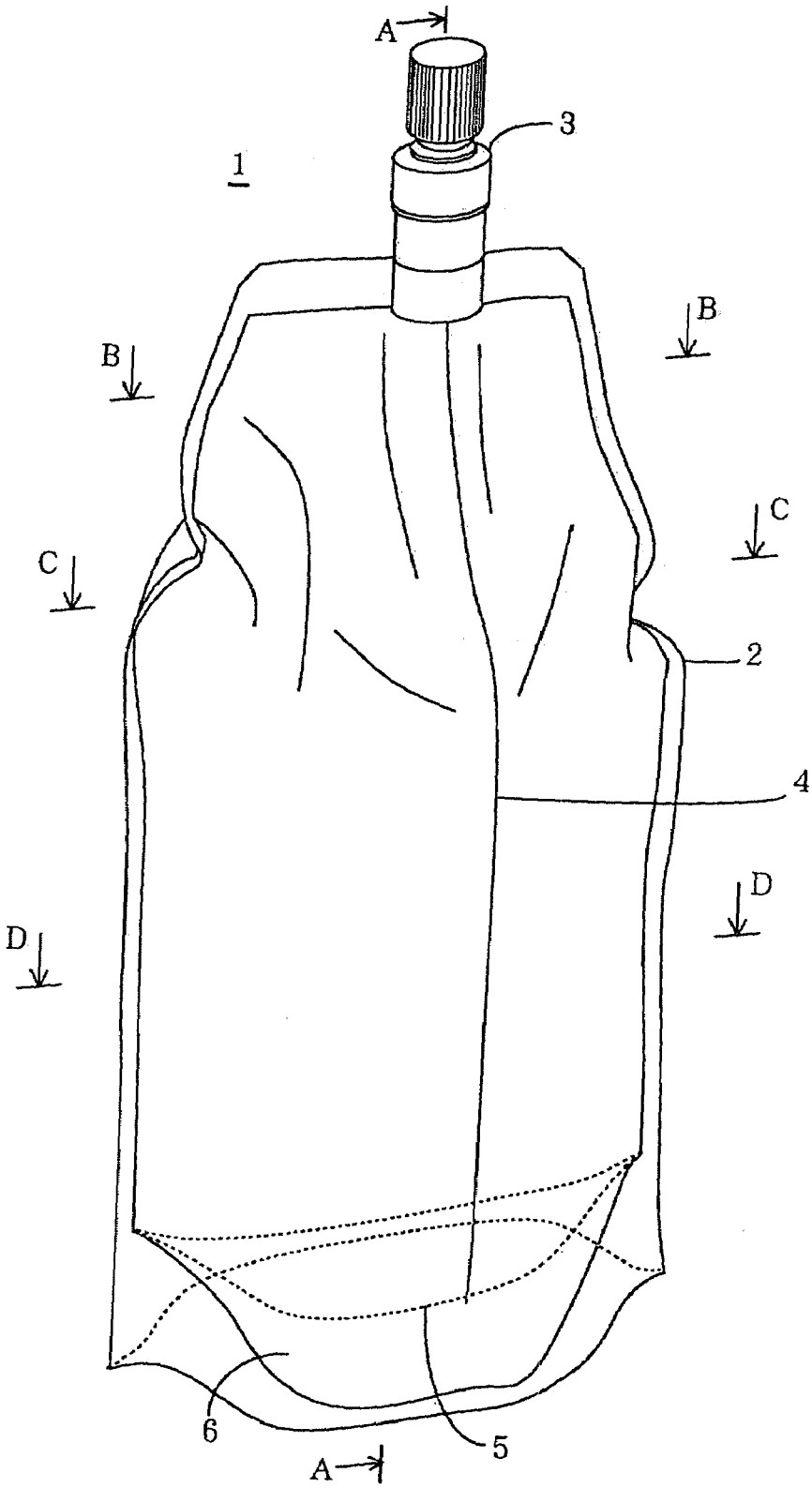
FIG. 1 is a perspective view showing a first embodiment of a container equipped with a structure for joining a sheet member and a tubular member in a pouch container of the present invention.

FIG. 1 is a perspective view showing a first embodiment of the present invention. A self-standing container 1 is a standing pouch formed from a soft sheet by an ordinary method, and is constructed by providing a pouring port 3 at an upper end of a container body 2 of the soft sheet portion. Further, outward protruding folds 4 are formed in the container body 2 to extend downward from a lower end of the pouring port 3 used as a starting point.

As for the material used for the container body 2 in FIG. 1, it is possible to select a plastic sheet, a metal sheet or a composite sheet which uses such sheets as structural materials. Examples of a plastic sheet include polyethylene, polypropylene, polyester, polycarbonate, nylon resin and the like. Using these soft sheets or a composite sheet as a raw material, heat fusing is carried out to form the container body 2 by applying two raw material sheets (body side wall sheet members) together and heat sealing the peripheries thereof over a prescribed width.

Further, a bottom portion sheet member 6 having a downward folded portion 5 is placed between the two raw material sheets at the bottom portion of the container body 2 and fused thereto. Accordingly, when the container body 2 is filled with contents, the folded portion 5 of the bottom portion sheet member 6 is opened, whereby the bottom portion sheet member 6 expands to form the bottom of the container 1. In this way, when the container body 2 in this state is placed on top of a table or the like, the container 1 stands on its own without any support.

Figure 2:
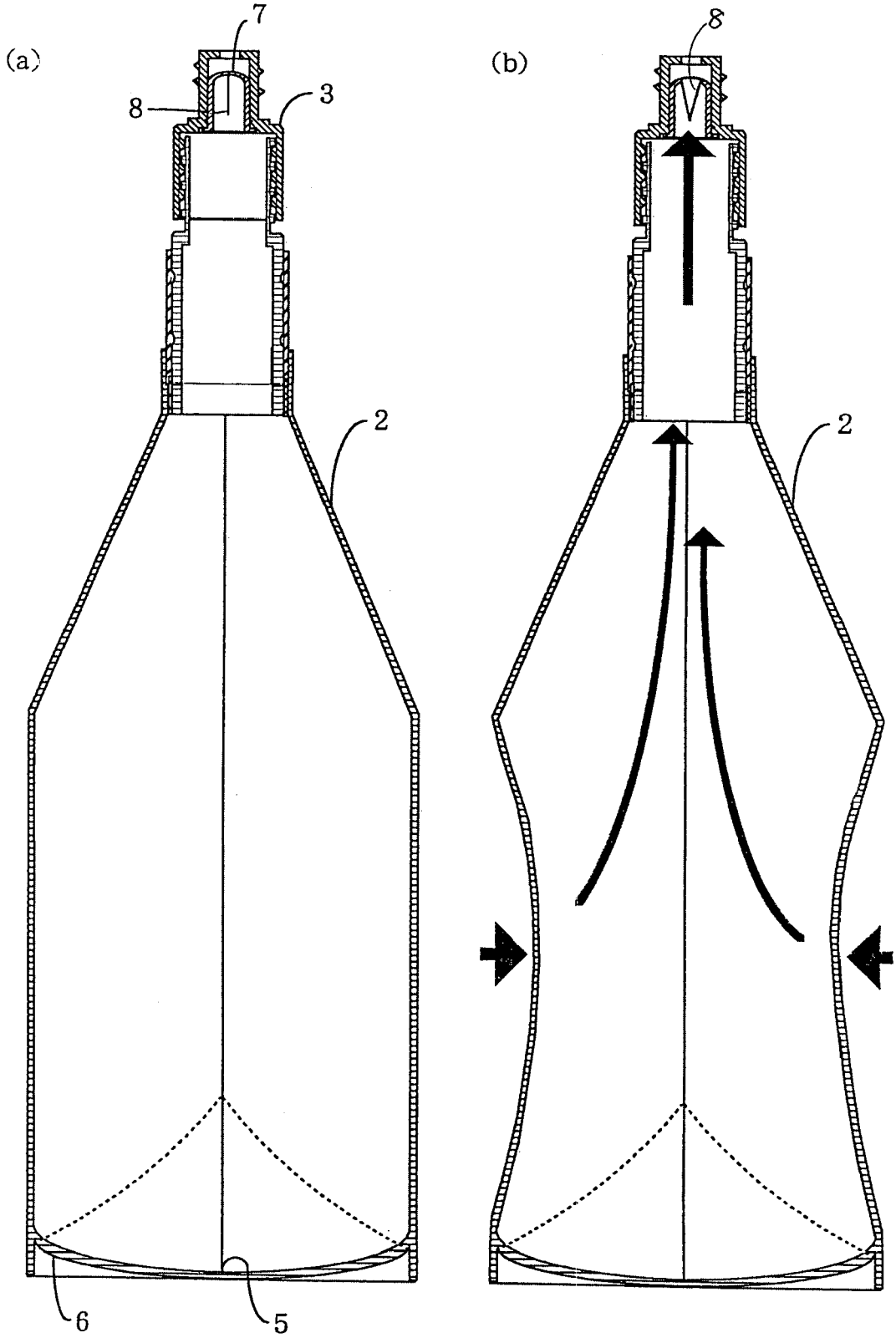
FIGS. 2(*a*) and 2(*b*) are cross-sectional views of the container shown in FIG. 1.

As shown in FIG. 2(*a*), a check valve 7 is provided inside the pouring port 3. The check valve 7 is formed by an elastic member made of rubber or the like to have a tubular shape, wherein a slit 8 which extends to the tubular side wall is provided in a head portion formed to have a dome shape. Then, as shown in FIG. 2(*b*), in the case where an internal pressure is created by manually squeezing the trunk portion of the container body 2, such internal pressure acts in the pouring direction to open the slit 8, thereby making it possible to pour the contents to the outside.

Next, when the grip on the container body 2 is released to remove the internal pressure, the slit 8 is closed instantly by the elasticity (restoring force) of the check valve 7 itself, and this prevents air from flowing in. At this time, because the downward flow phenomenon of the contents due to gravity creates a vacuum in the upper portion of the self-standing container 1, the check valve 7 is tightly sealed, and this makes it possible to completely cut off the inflow of air. By providing the check valve 7 in this way, it is possible to reliably prevent the contents inside the self-standing container 1 from being oxidized by contact with air.

Further, the vacuum in the upper portion of the container 1 has an effect of increasing the separation of the air dissolved inside the liquid contents from the liquid contents in accordance with the weight ratio thereof, and when the container 1 is stood up again after pouring out some of the contents, the shock transferred to the contents remaining in the container 1 causes the air dissolved inside the contents to form bubbles which are then sucked upward. Then, because the air that moves upward from below accumulates directly below the check valve 7, a higher oxidation preventing effect can be obtained by slightly squeezing the container 1 again to expel such accumulated air.

Further, the check valve 7 is not limited to the shape described above, and it is possible to use basically any type of valve for the check valve so long as such valve is classified as a check valve or one-way valve, such as a reed valve, a poppet valve, a pinch valve, a check ball valve or the like. In this regard, an appropriate valve is selected from these in accordance with the strength of the restoring spring force or elastic force and the properties of the contents.

Figure 3:
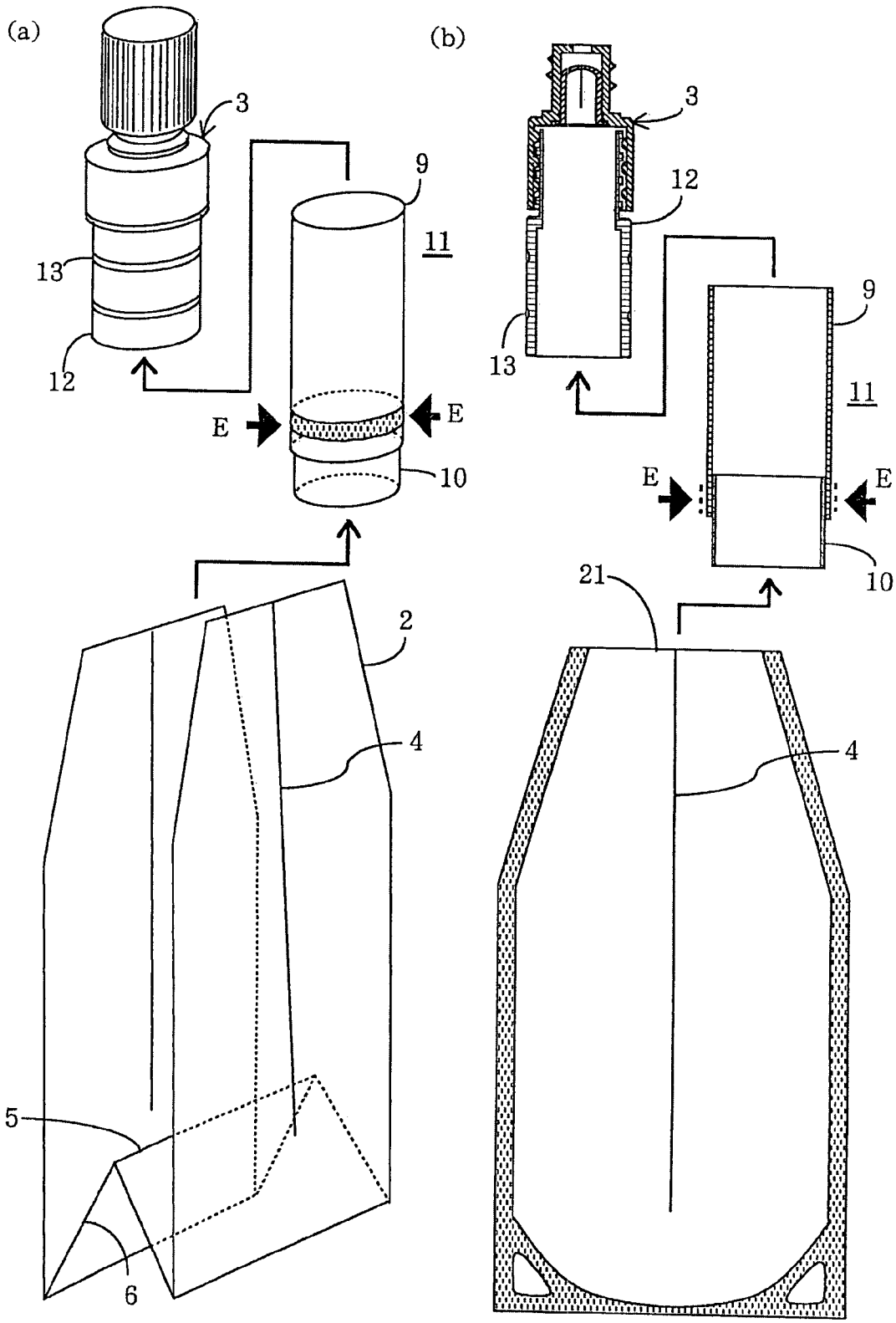
FIG. 3(*a*) is an explanatory drawing of the manufacturing process of a self-standing container, and FIG. 3(*b*) is a cross-sectional view thereof FIGS. 4(*a*) and 4(*b*) are cross-sectional views showing the joining state of an essential portion.
Figure 4:
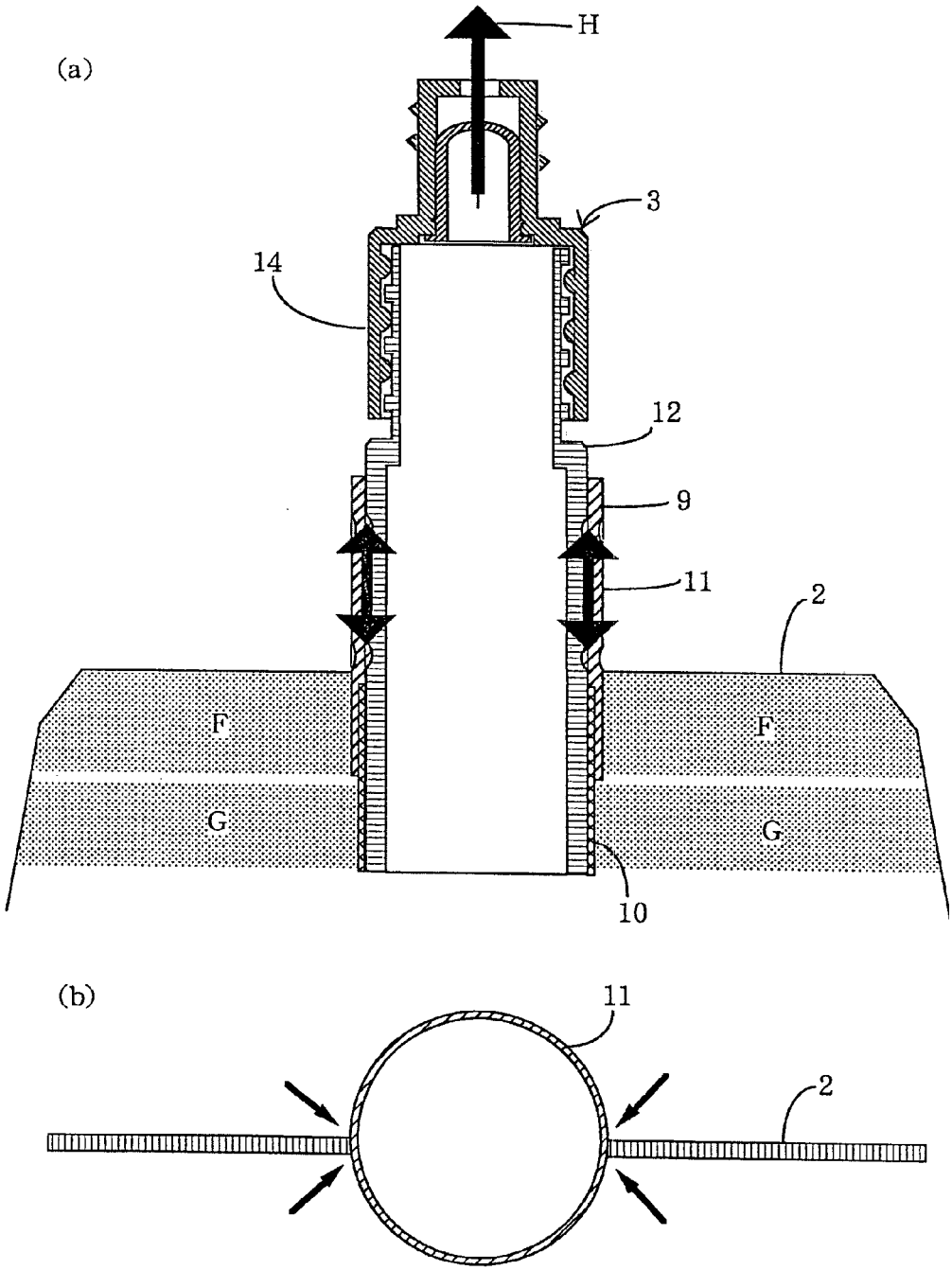

Next, the joint of the pouring port 3 and the container body 2 is shown in FIG. 3 and FIG. 4.

First, the folds 4 are formed from the upper end of the container body 2, namely, from the mounting portion of the pouring port 3 to the bottom portion of the container body 2. Preferably, the folds 4 are formed in advance by folding the raw material sheets. Then, after the container body 2 is formed in advance into a pouch by the method described above with only an opening 21 remaining in the upper end thereof, a joint tube 11 is formed by fusing a two-layer resin tube 10 formed by arranging a nonfusible material on the inside and a fusible material on the outside in the E direction to the inside of a lower end of a heat-shrinkable tube 9 so that the resin tube 10 protrudes a prescribed amount from the lower end of the heat-shrinkable tube 9.

Next, the joint tube 11 and the container body 2 are fused together. Namely, the lower portion of the joint tube 11 is inserted into the upper end opening 21 of the container body 2, and then the fusing of the container body 2 and the heat-shrinkable tube 9 of the joint tube 11, and the fusing of the container body 2 and the resin tube 10 of the joint tube 11 are carried out separately at F and G (see FIG. 4(*a*)). At this time, because the joint tube 11 is constructed from a thin tube, the joint tube 11 flattens easily when clamped, and for this reason, the joint portion (shown by the arrows in FIG. 4(*b*)) of the joint tube 11 and the container body 2 has a necessary and sufficient fusing strength.

A joint portion 12 which joins the pouring port 3 to the container body 2 is provided on the lower portion of the pouring port 3, and an appropriate number (two in FIG. 3) of grooves 13 are formed in the joint portion 12. Further, the joint portion 12 is inserted into the joint tube 11, and then the joint tube 11 is heated to shrink the heat-shrinkable tube 9 of the joint tube 11, whereby the joint tube 11 is fastened to the joint portion 12 of the pouring port 3. At this time, the heat-shrinkable tube 9 enters the grooves 13 of the joint portion 12, and this acts as a reliable stopper. Accordingly, a higher stopper effect can be obtained by appropriately forming many deep grooves 13.

In the self-standing container 1 constructed in this way, in the case where it is assumed that the pouring port 3 is used as a handle to lift the container 1 as shown in FIG. 4, an upward pulling force (or the gravitational force acting on the container body 2 filled with the contents) H is mainly received by the joint portion 12 of the pouring port 3 and the heat-shrinkable tube 9, and this force is dispersed from the heat-shrinkable tube 9 and the resin tube 10 to the fused portion of the container body 2.

In the prior art, regardless of the fact that a sufficient joint strength is not obtained by the means for joining a soft pouch portion and a hard tubular portion in this kind of container, the joint portion is easily damaged because stress is concentrated at such joint portion. Consequently, the prior art structure has the problem of making it impossible to construct pouch containers having large volumes, but the joint structure in the self-standing container of the present invention makes it possible to reliably prevent damage to the joint portion by dispersing stress.

Figure 5:
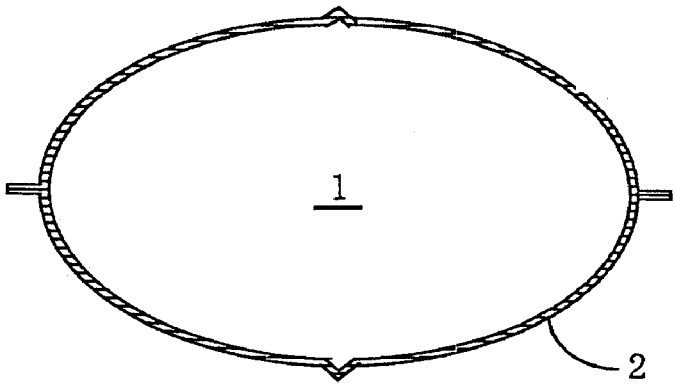
FIGS. 5(*a*), 5(*b*) and 5(*c*) are respectively cross-sectional views of each portion of a container body filled with contents.
Figure 5:
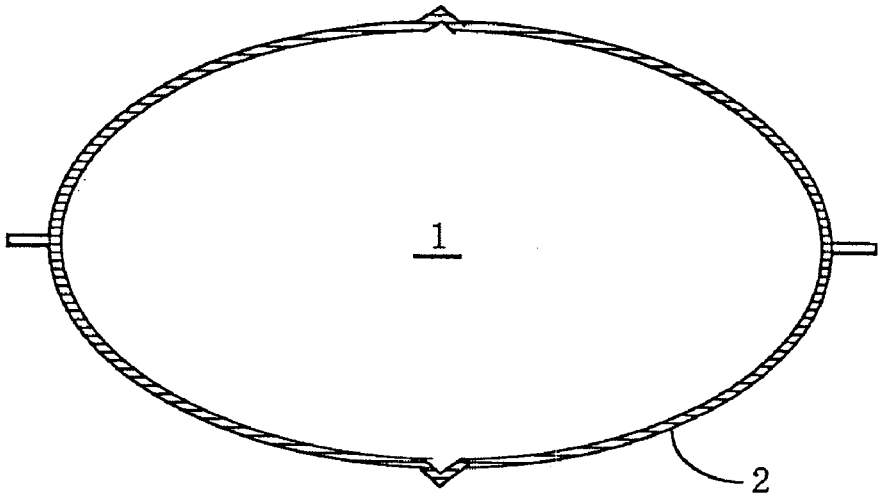
Figure 5:
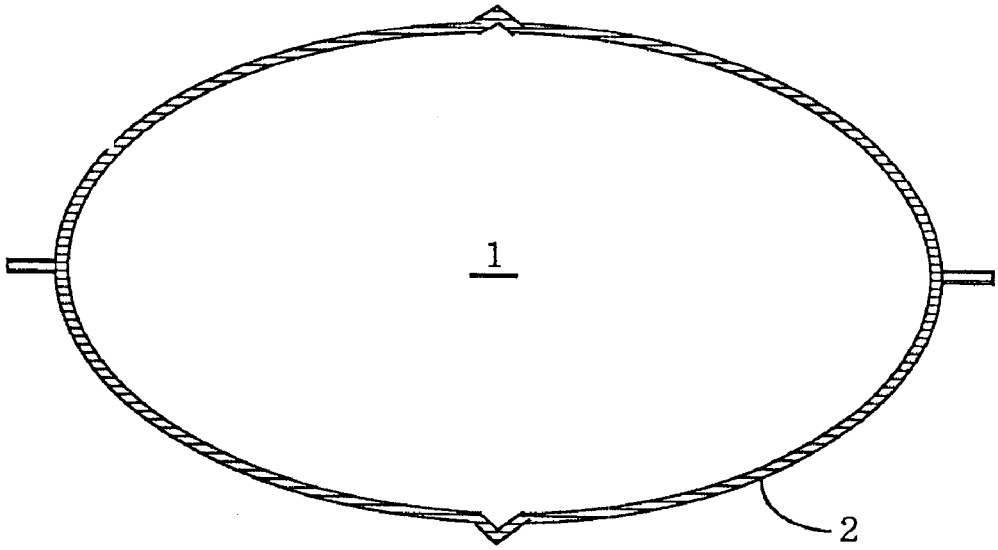

Cross-sectional views of each portion of the container body 2 taken along the lines B-B, C-C and D-D of FIG. 1 for the case where the self-standing container 1 constructed as described above is filled with contents (e.g., a liquid such as water or the like) are respectively shown in FIGS. 5(*a*), 5(*b*) and 5(*c*). Now, after the container body 2 is squeezed to pour out some of the contents as shown in FIG. 2(*b*), when the squeezing force on the container body 2 is released, because the weight of the contents causes the contents to flow downward to the bottom portion (downward flow phenomenon), and because air is prevented from flowing inside the container body 2 by the action of the check valve 7, a tightly sealed state is formed between the contents and the container body 2, whereby a vacuum is formed in the upper portion inside the container body 2. Namely, in contrast to the prior art hard structure which undergoes almost no deformation and which allows air to flow inside the container to fill the portion of the container emptied by the discharging of contents when the container is inclined with the discharge port in an open state, in the self-standing container 1 of the present invention, because the container body 2 is made of a soft material, when a quantity of contents is discharged, the container 1 is deformed and the volume thereof is reduced by an amount equal to the quantity of discharged contents. As a result, air is prevented from flowing into the inside of the container 1.

However, in the case where the container 1 is stood up, the contents become concentrated in the lower portion of the container 1, whereby the volume of the lower portion of the container 1 is increased, and the volume of the upper portion of the container 1 is decreased by the reduction of contents therefrom. In this regard, because the contents that remain inside the upper portion of the container 1 are acted on by a downward falling force due to the weight thereof and a pulling force from below due to surface tension, the internal pressure is believed to decrease toward a vacuum as the contents approach the check valve 7.

Figure 6:
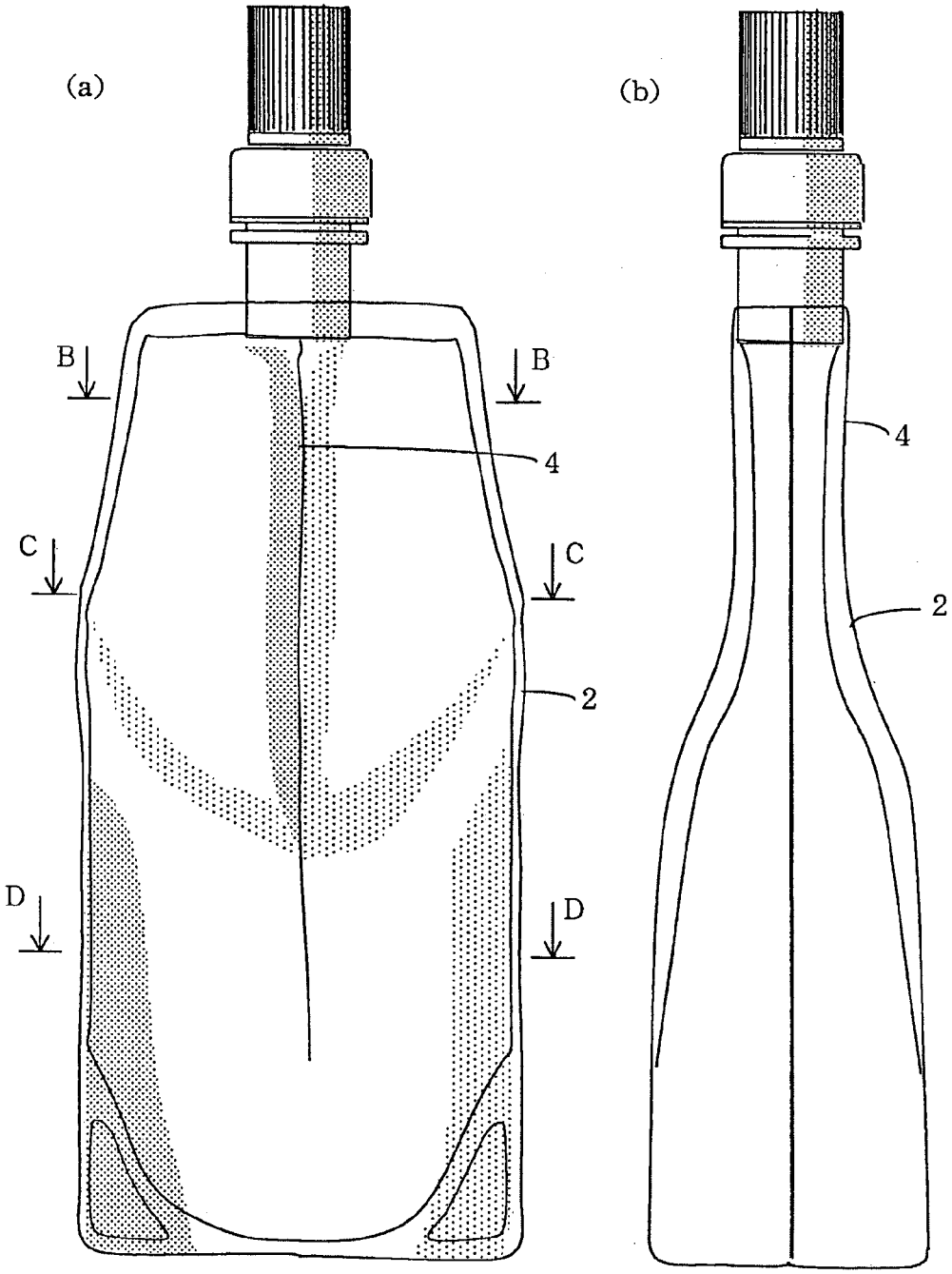
FIGS. 6(*a*) and 6(*b*) are respectively a front view and a side view of a self-standing container when the contents are reduced.
Figure 7:
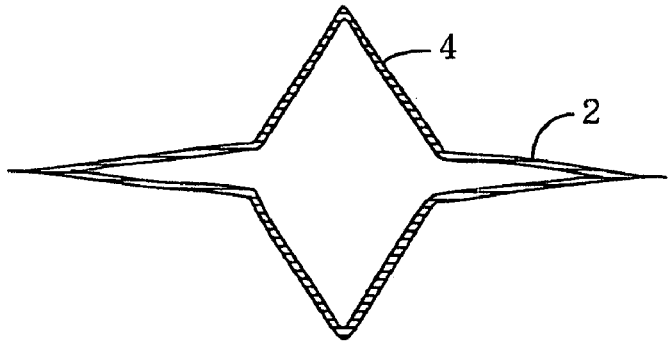
FIGS. 7(*a*), 7(*b*) and 7(*c*) are respectively cross-sectional views of each portion of a container body when the contents are reduced.
Figure 7:
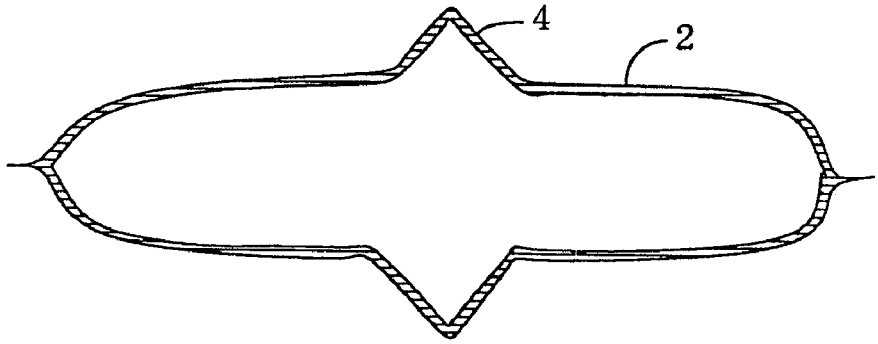
Figure 7:
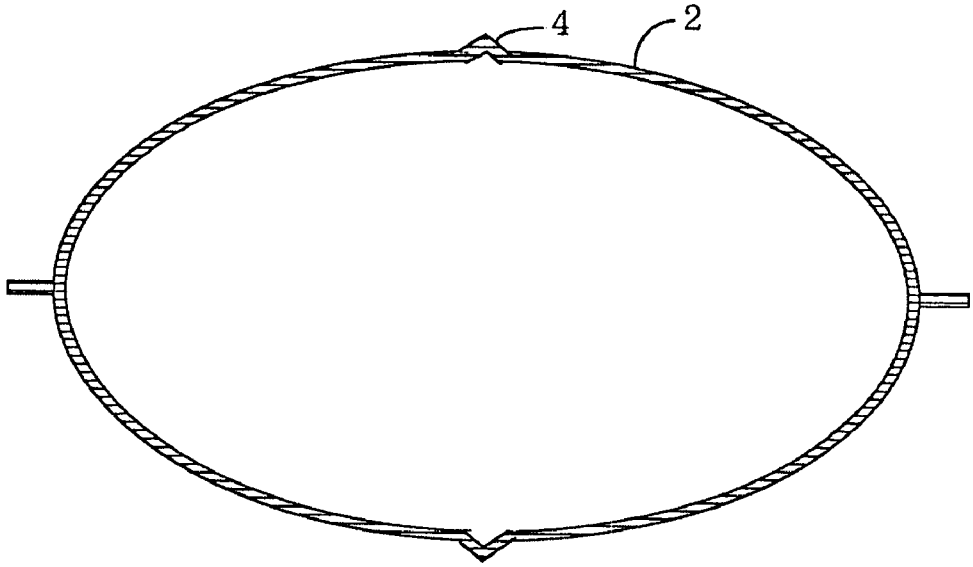

When the contents are discharged, the self-standing container 1 becomes thinner from the upper portion as shown in FIGS. 6(*a*) and 6(*b*). For example, FIGS. 7(*a*), 7(*b*) and 7(*c*) show cross-sectional views of each portion of the container body 2 taken along the lines B-B, C-C and D-D of FIG. 6(*a*) for the case where approximately 50% of the contents are discharged. Namely, a roughly square water column is formed by the folds 4 provided in the container body 2 from the lower end of the pouring port 3. Further, a square pole is clearly formed by the folds 4 at the upper portion of the container body 2 where the amount of contents is small, and this prevents bending in the thickness direction of the container 1. Accordingly, the square (liquid) column formed by the folds 4 prevents the container body 2 from falling down.

Figure 8:
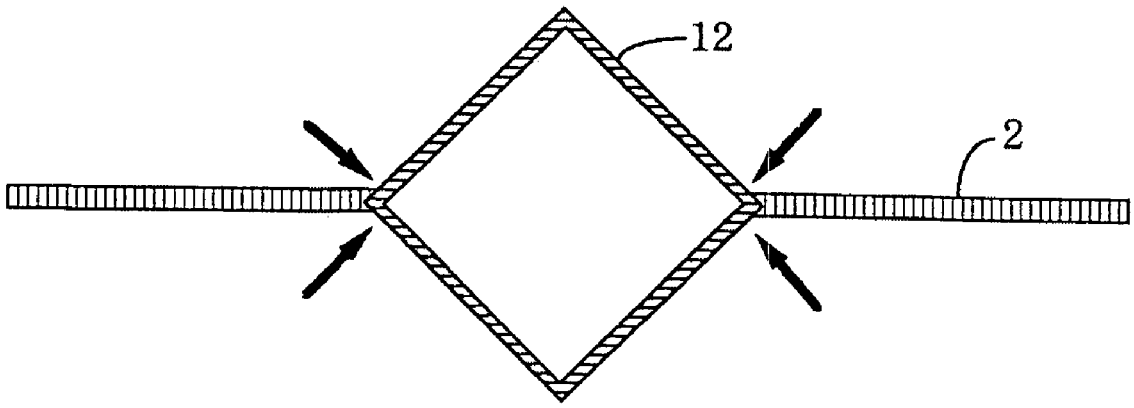
FIG. 8 is a cross-sectional view showing another embodiment of a container body.

FIG. 8 shows the lower portion of the joint portion 12 formed to have a square-shaped cross section. By forming a square cross section, the open angle of the joint portion 12 (the portion shown by the arrows in FIG. 8) of the container body 2 and the heat-shrinkable tube 9 or the resin tube 10 forms an obtuse angle, and this makes it more difficult to damage the joint portion 12. Further, this can be expected to have an effect of promoting the function of the folds 4 of the container body 2.

Of course, the cross section of the lower portion of the joint portion 12 is not limited to the circular shape and square shape described above, and it is possible to select an appropriate shape such as an elliptical shape, a shape in which both ends in the longitudinal direction have elliptical shapes which form an acute angle, or any other shape in accordance with the size and use and the like of the container 1. Further, in the same manner as ordinary standing pouch containers, because the self-standing container 1 can be folded for storage when the container 1 is not filled with contents, no space is wasted when the container 1 is stored. Further, when washing is carried out, the container 1 can be reused any number of times.

Further, in the embodiment described above, it was assumed that the self-standing container is used for beverages and the like, but the present invention is not limited to this, and it is of course possible to use the self-standing container for any liquid. Namely, the self-standing container of the present invention can be used for a wide variety of substances other than beverages, including viscous fluids, cosmetics, pharmaceuticals and the like.

Because the structure for joining a sheet member and a tubular member in the pouch container of the present invention is constructed as described above, the stress on the joint portion is dispersed, and this makes it possible to provide a pouch container which can reliably prevent damage to the joint portion.

What is claimed is:

1. A structure for joining a sheet member and a tubular member in a pouch container, comprising:

a two-layer resin tube having a nonfusible material arranged on the inside and a fusible material arranged on the outside;

a heat-shrinkable tube;

a joint tube formed by fusing the resin tube to the inside of a lower end of the heat-shrinkable tube so that the resin tube protrudes a prescribed amount from the lower end of the heat-shrinkable tube;

a pouch container body having an upper end opening; and a pouring port provided with a joint portion for joining the pouring port to the container body, the joint portion having at least one groove formed therein in the circumferential direction;

wherein a lower portion of said joint tube is inserted in the upper end opening of the container body, and the container body and the heat-shrinkable tube of the joint tube are fused and then the container body and the resin tube of the joint tube are fused separately, and wherein the joint portion of the pouring port is inserted in the joint tube, and the joint tube is heated to shrink the heat-shrinkable tube in order to fasten the joint portion of the pouring port to the joint tube.

* * * * *